United States Patent [19]

Bishop

[11] Patent Number: 4,852,532

[45] Date of Patent: Aug. 1, 1989

[54] ROTARY VALVE FOR INTERNAL COMBUSTION ENGINES

[76] Inventor: Arthur E. Bishop, 19 Buffalo Rd., Gladesville NSW 2111, Australia

[21] Appl. No.: 130,537

[22] PCT Filed: Jan. 23, 1987

[86] PCT No.: PCT/AU87/00018

§ 371 Date: Sep. 22, 1987

§ 102(e) Date: Sep. 22, 1987

[87] PCT Pub. No.: WO87/04489

PCT Pub. Date: Jul. 30, 1987

[30] Foreign Application Priority Data

Jan. 23, 1986 [AU] Australia ..... 52666/86

[51] Int. Cl.[4] ..... F01L 7/10; F01L 7/16

[52] U.S. Cl. ..... 123/190 BD; 123/80 BA; 123/190 E

[58] Field of Search ..... 123/80 BA, 80 BB, 80 D, 123/80 DA, 190 B, 190 BD, 190 BE, 190 BF, 190 D, 190 E

[56] References Cited

U.S. PATENT DOCUMENTS 3,871,340 3/1975 Zimmerman ..... 123/190 BD X
3,892,220 7/1975 Franz ..... 123/190 E
4,019,487 4/1977 Guenther ..... 123/190 E
4,036,184 7/1977 Guenther ..... 123/190 E X
4,404,934 9/1983 Asaka et al. ..... 123/190 BD

FOREIGN PATENT DOCUMENTS 0266020 2/1927 United Kingdom ..... 123/190 BD

*Primary Examiner*—Willis R. Wolfe
*Attorney, Agent, or Firm*—Hill, Van Santen, Steadman & Simpson

[57] ABSTRACT

A rotary valve for an internal combustion engine having a hollow cylindrical rotor having along its bore an inclined integral baffle with ports on either side of the baffle arranged to be brought into communication with a window as the hollow cylindrical rotor rotates, the rotor being supported by means of rollers supported in grooves formed in the surface of the rotor and bearing on the inside surface of a bore of the cylinder head. Seals are provided around the window, the seals consisting of sealing strips arranged in longitudinal grooves formed in the bore of the cylinder head and circumferential rings accommodated in annular grooves within the bore of the cylinder head, the longitudinal strips abutting in surface contact at each end of the surface of one of the circumferential rings.

4 Claims, 5 Drawing Sheets

ROTARY VALVE FOR INTERNAL COMBUSTION ENGINES

This invention relates to rotary valves for internal combustion engines in which a continuously rotating valve member incorporated in the cylinder-head replaces the conventionally used poppet valves.

Such rotary valves have been developed since the inception of the internal combustion engine. The arguments for their use include the improved smoothness of operation, the more rapid and precise opening and closing of the valve ports and the larger port openings that can be provided.

Most efforts have been made in the past to apply the rotary valve to single cylinder engines of high performance because of its ability to provide the large port openings needed when such engines are operated at very high speeds. In most cases these engines were air cooled. None of these developments has proved successful to a point where the engines went into mass production, primarily because of the difficulties experienced in sealing the valves and preventing rapid deterioration of sealing and journal surfaces due to heating and distortion resulting from the passage of hot exhaust gases through the rotary valve. Attempts to apply the rotary valve to multi-cylinder engines have been even less successful.

The overriding emphasis today is placed upon improved efficiency, control of emissions and on achieving reduced engine weight rather than achieving optimum engine performance for a given displacement volume as is the past. The rotary valve offers advantages in all three areas.

Firstly, the use of a rotary valve dispenses with the exhaust poppet valve (the head of which may reach temperatures as high as 900 degrees Centigrade) and so eliminates the prime cause of pre-ignition of the incoming charge of gas, and reduces the tendency to "knock" in an engine of given compression ratio. By permitting a higher compression ratio, greater efficiency and cooler running may be obtained.

Secondly, the instantaneous start and finish of valve opening characteristic of the rotary valve allows less valve "overlap" to be used, that is, the period of time, or angular rotation of the crankshaft during which the exhaust and intake valves are both open. Thus, with the poppet valve system, the exhaust and inlet valves commence and finish their motion from rest, and hence it is common practice to "overlap" such valves by an angle which may vary from about 40° up to about 90° rotation of the crankshaft in order to improve engine breathing. This matters little if the engine is designed primarily for maximum power output for a given displacement volume, but when such an engine with a large valve "overlap" is operated at low speeds or idle it runs very roughly and, in addition, unburnt gas passes from the inlet to the exhaust ports causing emission of unburnt hydro- carbons. This "overlap" can be virtually eliminated with the rotary valve, yet the large and rapid port openings of the rotary valve more than compensate for any loss of "breathing" attributable to the elimination of "overlap".

Thirdly, a rotary valve engine can be lighter and of less overall height than a poppet valve engine.

The basic problem with the rotary valve is that sealing must be achieved between surfaces when they are in rubbing contact whereas in the poppet valve system the sufaces are at rest when sealing. Two conditions of sealing are of particular importance. Firstly, the sealing of gas during combustion, when the gas reaches a pressure of several hundred P.S.I. at a temperature of about two thousand degrees F., and secondly the prevention of the entry of even minute quantities of oil into the combustion chamber during operation of the engine at low manifold pressure. Proper sealing in these two extreme cases and in the many intermediate cases is possible only if surface contact or near-surface contact is achieved.

Now the rotary valve as generally proposed comprises a cylindrical valve member or rotor journalled for rotation in a bore in the cylinder-head transverse to the piston axis. The rotor is hollow, having a bore extending from each end and terminating at an inclined baffle. In the region of the baffle are two circumferentially adjacent rectangular openings or ports each connecting to the bore of the rotor, one to each side of the baffle, providing passages which exit at opposite ends of the valve. Seals are provided at each end to communicate these passages and hence the rectangular ports to an exhaust manifold and to an inlet manifold respectively.

The rotor bore in the cylinder-head has a rectangular opening or "window" communicating to the top of the combustion chamber so that, as the rotor rotates, the exhaust and inlet ports of the valve are successively communicated to the combustion chamber via the "window". The periphery of the rotor along its axis interrupted by the ports will be termed the "sealing zone".

The ports are adjacent in the rotor and together occupy a little less than half of the circumference of the valve. The "window" subtends an angle of about fifty degrees, so that one or other port is open to the window for just over one half turn of the valve. The side of the valve opposite to the ports is plain and so serves to seal the "window" during compression and expansion strokes of the piston.

The "sealing zone", if "unwrapped" from the periphery of the rotor, would appear an elongated rectangle in which there are two adjacent rectangular ports. The "window"would appear as a short rectangle which is traversed by the long rectangle as the valve rotates.

A number of different sealing situations, which are critical for satisfactory operation of the engine, occur as the valve rotates, and as the mode of operation of the engine changes. For example, at full throttle, combustion gas must be prevented from escaping from the "window" during compression or expansion strokes either axially along or circumferentially around the valve to the inlet or exhaust ports or to a lubricated zone in the cylinder-head where the rotor is journalled.

During part-throttle operation or idling, the pressure in the inlet manifold is below atmospheric and exhaust gases must be prevented from passing from the exhaust port to the inlet port. Also under these circumstances, oil used to lubricate the journals or the window or into the inlet port. In particular, such sealing must be effective under engine over-run conditions, when the manifold pressure and the cylinder pressure intermittently may approach a high vacuum. A rotary valve which fails to perform if any of these modes of operation will fail to meet the performance requirements demanded of the automobile engine in today's environment.

Providing the necessary surface-to-surface contact under the varying circumstances is complicated by the fact that the rotor tends to get hot along the side adjacent to the exhaust port, but to remain relatively cool on the side adjacent to the inlet port. A difference of several hundred degrees Farenheit may occur, as a result of which the valve will "bow" convexly on the hot side. A further cause of "bowing" of the rotary valve is the deflection which occurs when the high gas pressure acts upon one side of the valve in and around the "window". Such loads will be very large at the instant of ignition and must be carried into the cylinder-head by a journal arrangement. If the journal between the rotary valve and the cylinder-head lies within the sealing zone as happens with the design of many prior art inventions, then the effects of "bowing" of the rotary valve, either because of heat distortion or deflection under gas load will be minimal. However, the lubricant necessary for such a bearing to operate will now be exposed to the combustion chamber as the periphery of the rotary valve passes the "window", and such arrangements have proved unsuccessful.

If the journals are placed one on each side of the sealing zone as proposed by other inventors, using either plain or anti-friction rolling bearings, then this zone will, as a result of "bowing", run eccentrically, and flexible or moving sealing elements must be provided to maintain surface-to-surface sealing. The most critical sealing area is undoubtedly that surrounding the "window", and designers frequently provide in the cylinder-head a spring-loaded floating "shoe" which incorporates the "window". The "shoe" is generally circular and hence the area exposed to gas pressure is necessarily considerably larger than the area of the rectangular "window" it circumscribes and hence the "shoe" will be "journalled" against the rotary valve to carry the difference in area between the circle and rectangle, and hence require to be lubricated. Such arrangements appear prominently in the prior art, but appear to suffer problems of excess oil usage.

Many various solutions to these problems have been proposed by inventors, for example, Lorenzen, in German Pat. No. 192230 dated 1906, Keller in U.S. Pat. Nos. 1,513,911, dated 1922, Montalto in 2,048,134 dated 1934 or Cross in 3,990,423 dated 1976.

The present invention seeks to overcome the limitations of the prior art which presumably, have Precluded their use notwithstanding the great advantages offered by the rotary valve system. The Rotary valve of Zimmerman in U.S. Pat. No. 3,871,340 has certain features in common with the present invention. Thus, each rotary valve of a multicylinder engine is carried on ball races in the cylinder head and incorporates a spiral gear which meshes with a spiral pinion on a longitudinal shaft parallel to the crankshaft. However the "shoe" arrangement referred to above is used with its attendant lubrication problems.

The invention of Kremer shown in U.S. Pat. No. 4,019,488 of 1977 addresses the sealing problem in a manner superficially similar to that of the present invention in that it employs longitudinal seal strips adjacent to the window, but does not address the problem of longitudinal leakage in a practical fashion.

A closer approach to the present invention is exampled by the inventions of Guenther in U.S. Pat. Nos. 4,019,499 and 4,036,184. Both patents relate to the family of Rotary Valve Engines in which one or two elongated rotary valves are arranged parallel to the crank shaft and serve several cylinders and in which exhaust and inlet passages pass diametrally through the elongated valve bodies at each cylinder and serve to connect ports in the bore in which the rotary valve operates to a cylinder port below and a manifold port above. The rotary valves rotate at one quarter crank shaft speed (not one half, as in the present invention) so that gases, both inlet and exhaust, pass diametrally through the valve body, first in one direction and then the other. By this means heating effects resulting from the passage of exhaust gases are exactly symmetrical with respect to rotary valve axis, and hence heat distortion (bowing) is avoided.

Moreover such elongated valve bodies, supported in bearings between each cylinder, are in the nature of continuous beams so the maximum deflection (which occurs at the mid points between bearings) is only one quarter of that of a valve of the type which is a subject of this invention, which is in the nature of a simple beam. For these reasons the clearance between the valve body and the bore in which it operates, for rotary valves of Guenther, is only a small fraction of that needed in rotary valves of the present invention. On the other hand, Guenther's valve arrangement reduces the port area, for a given diameter of rotary valve, to one half that provided by rotary valves of the type of the present invention, greatly reducing the gains offered by the use of the rotary valve. For these reasons Guenther's seals are not practical in the present environment.

Thus the ring-shaped end gas seals (U.S. Pat. No. 4,019,487), which are spring loaded into contact with the (axially extending) side gas seals, would immediately be blown out of sealing contact during firing were they not protected primarily by the seal afforded by the close fitting of the valve body and bore. This spring loading would also prevent the ring shaped gas seals following the movement of the valve body if bowing occurred as is inevitable in valves of the present invention.

In U.S. Pat. No. 4,036,184 the end seals comprise short strips housed within notches machined within the bore in gas or oil axially along the rotary valve, over most of the circumference of the valve (i.e., the arc not subtended by the end seals), is opposed only by the closeness of fit of the valve body to its bore, a fit possible only with this class of rotary valve.

Equally important as the construction of the seal strips and end rings is the grooves and notches within which they operate. Thus the strips must operate with side clearance (of around 0.002") within the grooves within which they operate just as in the case of piston rings, and hence some acceptable leakage can occur from the sealing surface down to the space in the groove below the seal strip or ring (typically about 0.020"). If this latter space is itself not closed (as is the case of a piston ring) then unacceptable leakage will occur.

This blockage of the leakage paths between the various areas of the sealing zone and the adjacent lubricated bearing areas—by virtue of the very specific configuration of the seals and grooves within which they operate, and notwithstanding larger diametral clearances provided in the subject class of rotary valves, is an essential feature of the present invention.

Many designs employ ball or roller bearings, one at each side of the sealing zone, to journal the rotary valve in the cylinder-head as in the present invention. Such races, as manufactured, inevitably have some radial slack and also have some eccentricity between the raceway itself and the bore of the iner race. Thus, a rotary valve so journalled may move within the bore due to bearing clearance and will run eccentrically in the sealing zone due to manufacturing tolerances and so add to the requirement of clearance characteristic of this type of rotary valve.

SUMMARY OF THE INVENTION

According to one aspect of the present invention, these sources of error are eliminated by employing needle roller bearings running directly in grooves ground in the rotary valve at the same time that the outside diameter of the rotary valve is ground. Thus this source of eccentricity is eliminated. At the same time the outer raceway of the needle roller bearings is provided by the bore in the cylinder-head in which the rotary valve operates so eliminating clearances associated with the eccentricity of the inner raceway. Each rotary valve is selectively fitted to a corresponding bore of the cylinder-head to give the required minimal clearance needed to cater for the "bowing" which occurs in operation. Needle raceways are then selected to achieve the desired slack-free fit of the journals and hence maintain the desired clearance over the life of the engine. The needle roller bearing raceway, being integral with the rotary valve, may be positioned axially directly adjacent the sealing zone, thereby reducing the span and hence the effects of "bowing" either due to heat distortion or load.

Furthermore, according to another aspect of the present invention an array of juxtaposed sealing strips and rings housed within the cylinder-head and bearing on the rotary valve forms a floating frame around the "window" and the sealing zone to provide surface-to-surface sealing in the most critical leakage paths. This array comprises two sealing strips of rectangular sections arranged longitudinally within the valve bore in the cylinder-head, one each side of the window, terminating in a sealing circumferential grooves formed within the valve bore, one adjacent each end of the window. The grooves within which the seal strip and rings operate are all "blind", so that the spaces below the seals and rings do not communicate directly with each other or with the journal zones.

These rings are rectangular in cross-section and preferably each comprises 3 or more interlocking members which are urged into close contact with the rotary valve by leaf springs. The invention will now be described with reference to the drawings.

Figure 8:
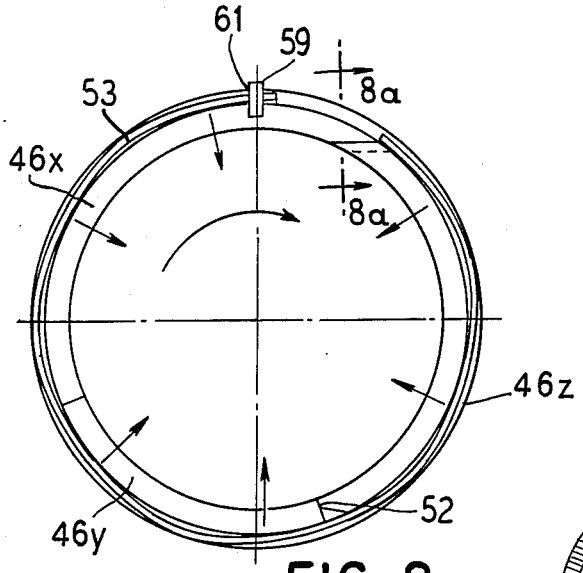
FIG. 8 is a side elevation of a sealing ring.
Figure 8A:
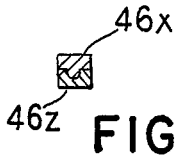
Figure 9:
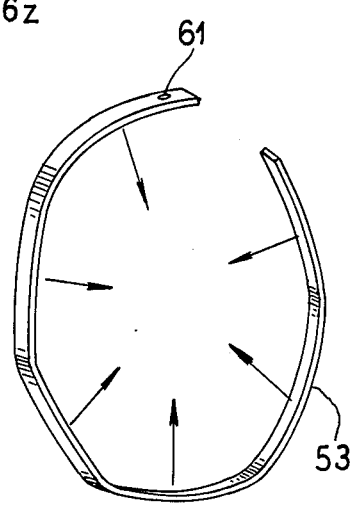
Figure 10:
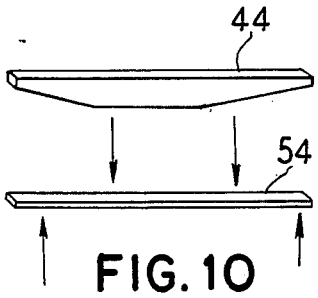

FIG. 8*a* is a cross-sectional view through the sealing ring of FIG. 8;

FIG. 9 is a perspective view of a supporting spring for a sealing ring;

FIG. 10 shows as strip seal and a corresponding supporting spring; and

Figure 2:
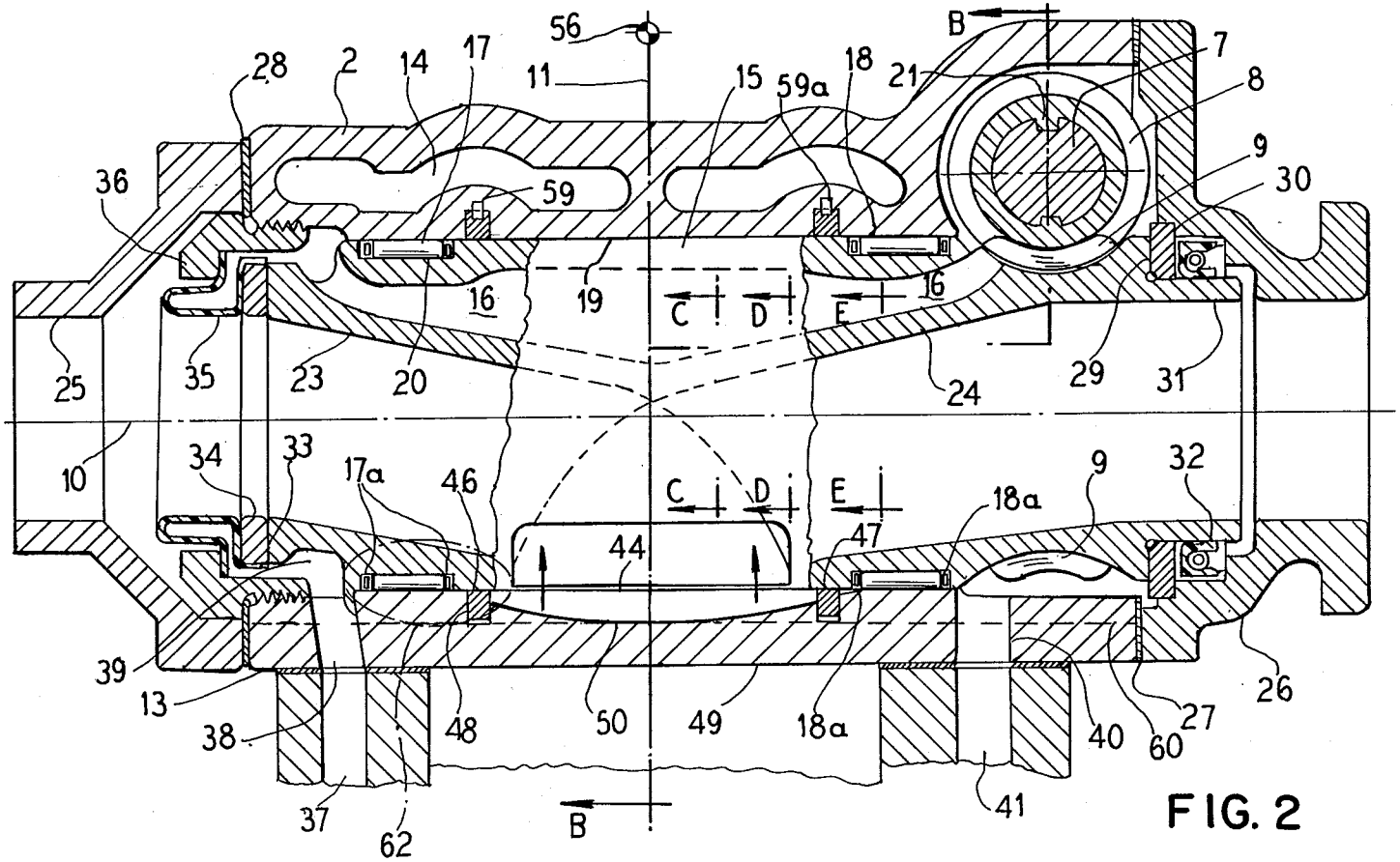
FIG. 2 is a section on line A—A of FIG. 1.
Figure 3:
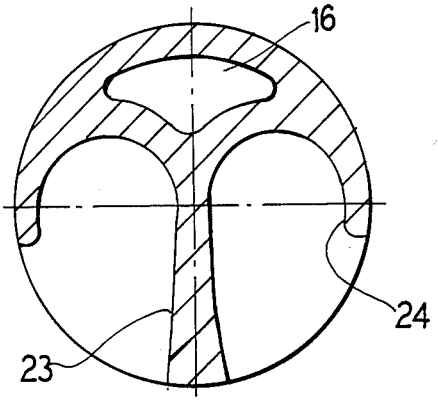
FIGS. 3, 4, 5 and 6 are cross-sectional views of the rotor on lines B—B, C—C, D—D and E—E respectively.
Figure 4:
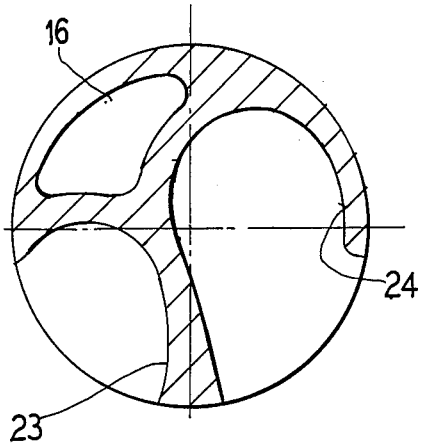
Figure 5:
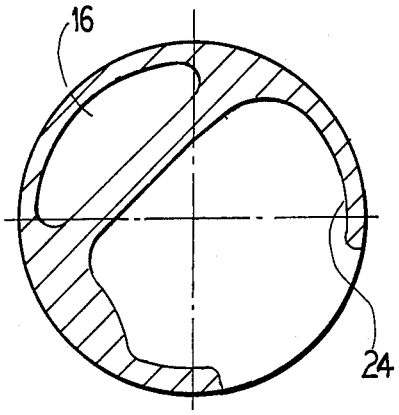
Figure 6:
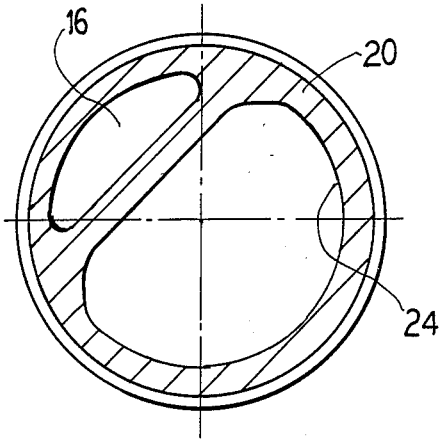
Figure 11:
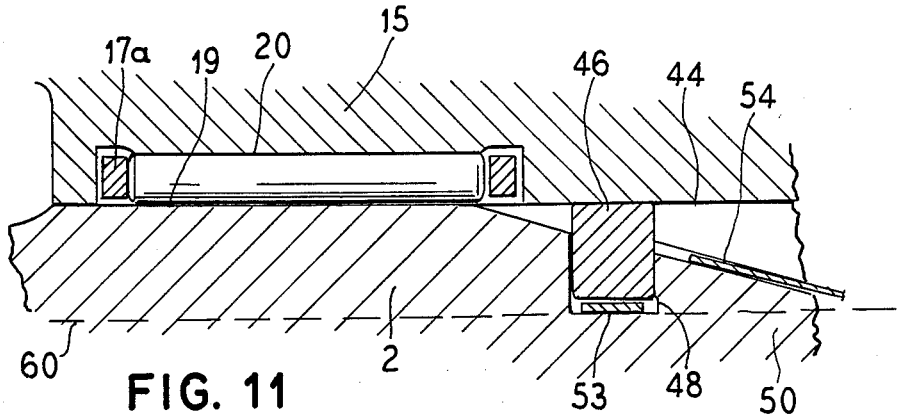

FIG. 11 is a cross-sectional view to an enlarged scale of a portion of FIG. 2 indicated by the oval area 62.

The present invention in a first aspect consists in a one piece rotary valve for an internal combustion engine comprising a hollow cylindrical rotor having at some point along its bore an inclined integral baffle, two rectangular ports in the periphery of the valve positioned along the axis adjacent the baffle, one port communicating with the bore on one side of the baffle and vice versa, a cylinder-head having a bore in which said rotor rotates in close-fitting relationship but without contact therewith, a window in said cylinder-head bore communicating with a combustion chamber, grooves formed in the periphery of the rotor spaced along the axis of the rotor, one each side of said ports, said grooves housing an array of rolling elements for journalling said rotor directly in said bore of the cylinder-head, said rollers serving to maintain a previously determined precise relationship between the surface of the rotor and the bore of said cylinder-head.

The present invention in a further aspect consists in a one piece rotary valve for an internal combustion engine comprising a hollow cylindrical rotor having at some point along its bore an inclined integral baffle, two rectangular ports in the periphery of the valve positioned along the axis adjacent the baffle, one port communicating with the bore on one side of the baffle and vice versa, a cylinder-head having a bore in which said rotor rotates in close-fitting relationship but without contact therewith, a window in said cylinder-head bore for communicating with a combustion chamber, bearing means spaced along the axis of said rotor, one on each side of said ports for journalling said rotor in said cylinder-head, an array of sealing means housed within said bore of said cylinder head comprising at least two longitudinal sealing strips housed within longitudinal grooves formed within said bore, one on each side circumferentially of said window, and at least two circumferential rings housed within annular grooves or recesses provided within the bore of said cylinder-head, each positioned along the axis of the bore immediately adjacent said window, said longitudinal sealing strips abutting in surface contact at each end thereof the surface of one said cylinder rings, spring means urging said circumferential rings and said longitudinal strips into close surface contact with said rotor so that the entire said array of sealing means maintains close surface contact with the periphery of said rotor notwithstanding small deviations of concentricity of said rotor within said cylinder-head bore, the grooves within which the seal strips and rings operate all being "blind", so that the spaces below the seals and rings do not communicate directly with each other or with the journal zones.

EMBODIMENT OF THE INVENTION

Figure 1:
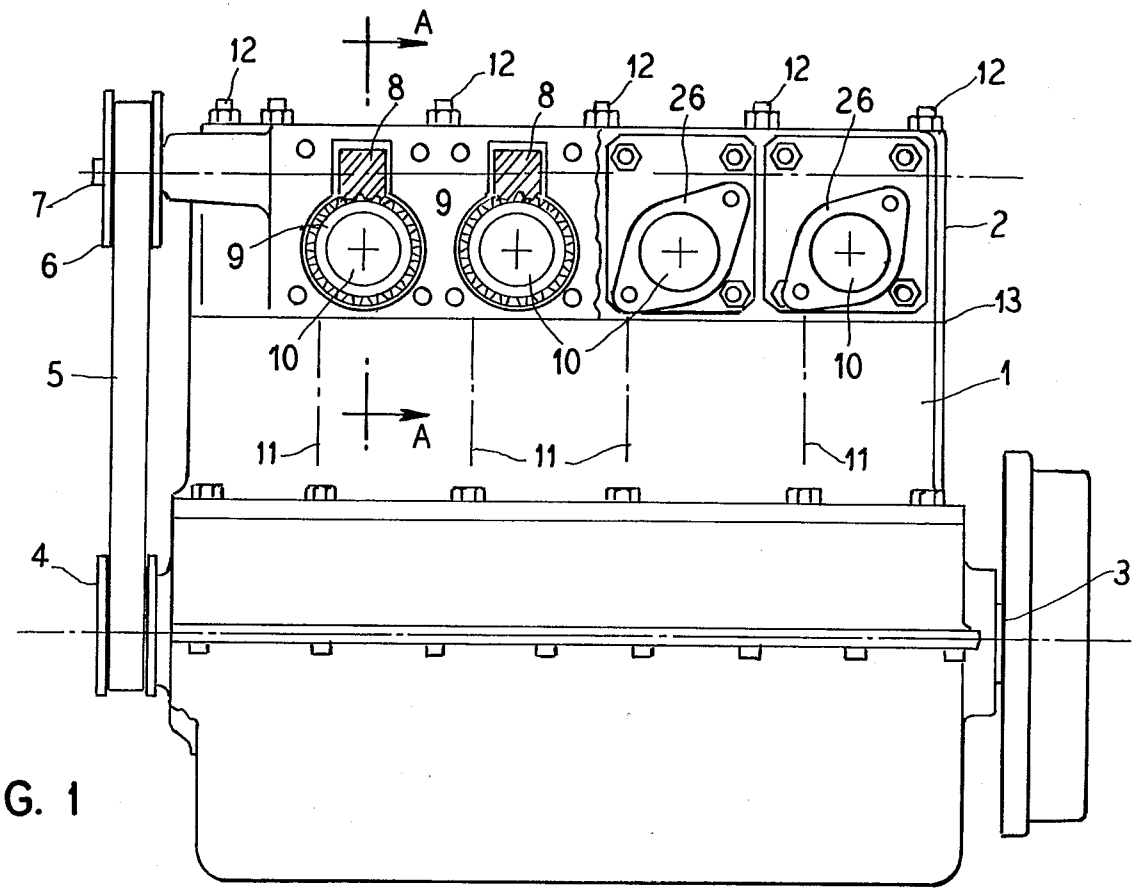
FIG. 1 is a side elevation of a four cylinder engine incorporating the invention.

In order to illustrate a practical embodiment of the invention, FIG. 1 shows the application to a four cylinder engine having cylinder block 1 and cylinder-head 2. The axes of the four cylinders are shown by chain-dotted lines 11.

Crankshaft 3 is provided with a conventional flywheel and has pulley 4 located at its front end. Timing belt 5 drives pulley 6 mounted on rotor drive shaft 7 journalled in cylinder-head 2. Located in the cylinder-head are four rotary valves having rotors whose axes of rotation are shown at points 10.

Cylinder head 2 is secured to crank case 1 by studs 12 and sealed by gasket 13 in the conventional manner. The lower part of the engine, comprising cylinder block 1, pistons, connecting rods, crankshaft, crankcase, oil pan, and etc. are entirely conventional and the novelty of the invention lies solely in the cylinder-head and associated mechanisms. Timing belt pulley 6 is preferably of the same diameter as pulley 4 mounted on the crankshaft, so that the rotor drive shaft 7 rotates at the same speed as the crankshaft 3 rather than half the speed as for the camshaft of a conventional engine.

In this view the covers of the drives to the first two rotary valves have been removed to show worms 8 on mounted on drive shaft 7 driving worm wheels 9 incorporated in the rotors on axis 10; The drive ratio provided by the worm and wheel is preferably 1:2 so that the rotors rotate at half the speed of the crankshaft 3.

FIG. 2 is a section on line AA of the cylinder-head 2 without the covers referred to above removed. Cylinder head 2 preferably is made of a hardenable grade of cast iron, induction hardened in certain areas as will be described later. Passages 14 are provided for the circulation of the cooling water. Rotor 15 is preferably made of a casting grade of steel and has cored passage 16 for the circulation of cooling oil. Rotor 15 is carried on needle roller bearings 17 and 18 which bear on the inside diameter of bore 19 of cylinder-head 2.

These needle roller bearings are of the type in which cages 17*a* and 18*a*, used to maintain alignment of the needles, are in two pieces to enable assembly over the grooves 20 of rotor 15.

Rotor 15 incorporates worm wheel 9 and is driven by worm 8 mounted on worm drive shaft 7 which is provided with longitudinal opposed splines 21.

Rotor 15 incorporates exhaust passage 23 and inlet passage 24 communicating with exhaust manifold 25 and an inlet manifold (not shown) secured to inlet cover 26 which is bolted to cylinder-head 2 and sealed by a gasket 27. The exhaust manifold is sealed by gasket 28.

At the inlet passage end of rotor 15 a shoulder 29 is provided to act as a thrust journal against bronze thrust ring 30. The extended end 31 of rotor 15 runs in seal 32 installed in cover 26.

At the exhaust end of rotor 15 a flat flange face is provided at 33 which engages seal ring 34 housed in spring bellows 35. This seal ring will preferably be of carbon or other non-metallic material not requiring lubrication.

Bellows 35 is secured to cover 36 which is screwed into the internally threaded end of a cylinder-head 12. Bellows 35 is designed to exert a small axial force on rotor 15 to maintain shoulder 29 in contact with thrust ring 30. Other forces combine to supplement this small force, including the thrust produced by rotation of worm 22 (counter-clockwise in FIG. 2) and the gas pressure in passage 24 which will always be less than, and sometimes much less than the pressure in exhaust passage 23.

Cooling of rotor 15 is accomplished by radiation to the adjacent surface of bore 19 which is cooled by water in passage 14 and also by the flow of oil in passage 16.

For this purpose oil from the engine oil pump (not shown) flows upwardly in passage 37 of cylinder block through drilled passage 38 into annular space 39 formed by the necked-down part of rotor 15. It then flows along the rotor in passage 16 and escapes into the section of the cylinder-head which houses the worm drive 8–9. From here it returns to the sump through passages 40 and 41. At the same time as cooling rotor 15, the oil serves to lubricate sealing face 33, bearings 17 and 18, worm and wheel 8 and 9, thrust face 29 and seal 32.

The shape of the passages 16, 23 and 24 in rotor 15 are of complex form and only approximately represented in FIG. 2. FIGS. 3, 4, 5 and 6, being sections through the rotor successively more remote from cylinder axis 11, show the form of these passages. Similar sections apply on the left hand side of cylinder axis 11.

Figure 7:
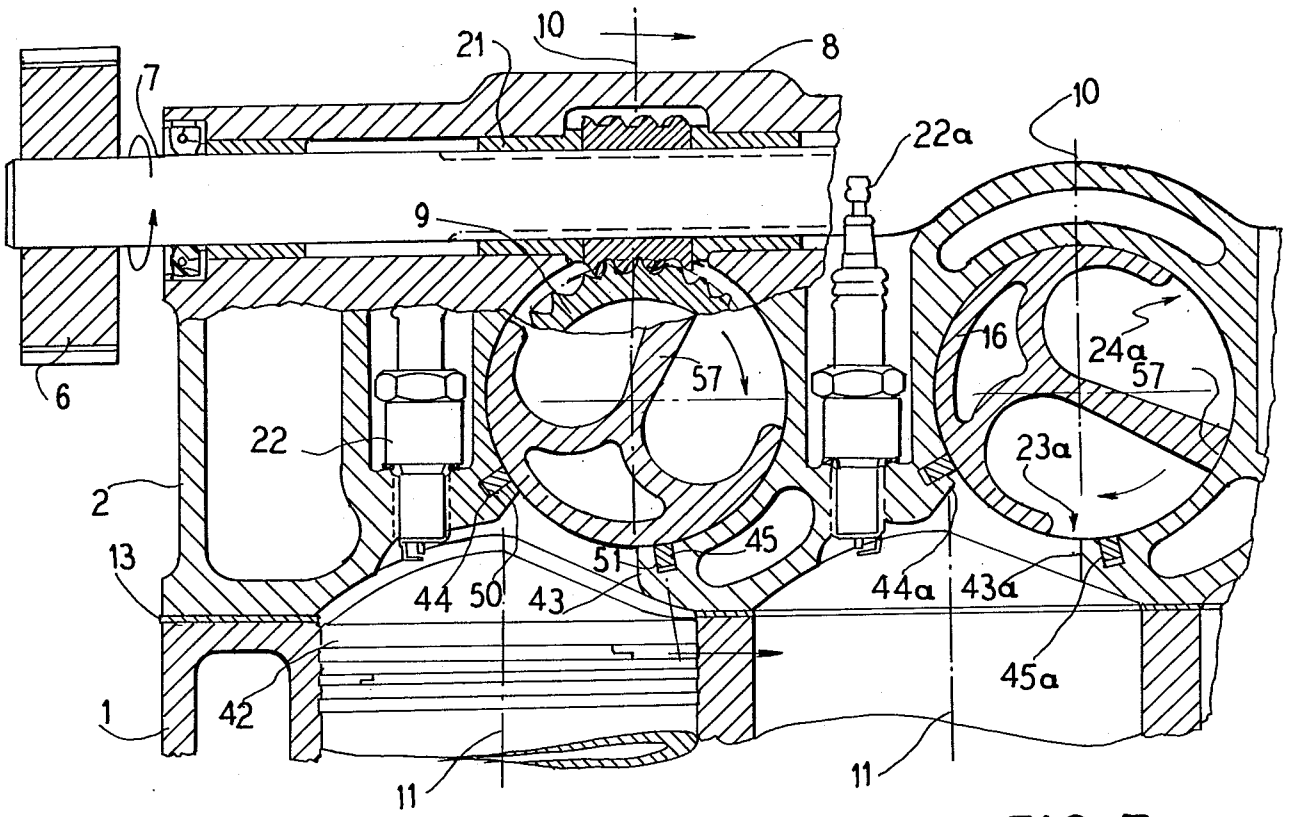
FIG. 7 is a cross-sectional view on line B—B of FIG. 2, with the engine positioned at the top-dead-centre position of the left hand cylinder.

Referring now to FIG. 7 it will be seen that when piston 42 is at the top of its stroke in the left cylinder, rotor 15 has fully closed head window 43. Note that this position of the engine differs from that represented in FIGS. 2 to 6. Meantime in the right hand cylinder the piston (not shown) is at the bottom of its stroke and the remaining gas in the cylinder is being expelled through window 43*a* and exhaust port 23*a* of rotor 15*a*. Upon about 90 degrees further rotation of rotor 15*a*, inlet passage 24*a* will open to window 43*a* to provide a new charge of gas.

It is appropriate now to consider the problems of sealing the rotary valve with reference to FIGS. 2, 7, 8, 9, 10 and 11. The seal array comprises two circumferential ring seals 46 and 47 and two longitudinal strips seals 44 and 45 all of which "float" with and maintain surface-to-surface contact with rotor 15 by reason of an arrangement of springs to be described. Furthermore, ring seals 46 and 47 maintain surface contact sealing with the ends of strip seals 44 and 45.

Ring seals 46 and 47 are housed in internal grooves 48 and 49 respectively in the bore 19 and have minimal side clearance, for example, 1 to 2 thousandths of an inch. Strip seals 44 and 45 fit similarly closely in their corresponding longitudinal grooves 50 and 51.

Thus considering the case of the left cylinder of FIG. 7 where the pressure is high in window 43, the window is "framed" by an array of seals all of which are in surface contact with the rotor and their associated grooves. Thus, due to gas pressure, all seals will be driven away from window 43; strip seal 44 clockwise, strip seal 45 anticlockwise, ring seal 46 to the left and ring seal 47 to the right. Moreover, because seals 46 and 47 extend right around the periphery of the rotor, this same frame prevents ingress of oil along the rotor from bearing 17 and 18 into the sealing zone. Thus, even if rotor 15 has some clearance in bore 19, each of the two most critical leakage paths referred earlier will be sealed by surface contact.

It is preferred that seal rings 46 and 47 each comprise three segments, 46*x*, 46*y* and 46*z* as shown in FIG. 8.

Segments 46*x* and 46*y* abut each other as do segments 46*y* and 46*z*, and so seal each to the other. The junction of 46*x* and 46*z* is made with a tenon and groove form as shown in FIG. 8*a*. This allows segment 46*z* to be pivoted about point 52 for withdrawal and assembly of the three piece ring.

A wave spring strip 53 (FIG. 9) serves to urge all three segments of rings 46 and 47 into contact with rotor 15, applying pressure evenly at the points such as indicated by the arrows of FIGS. 8 and 9.

In the case of strip seal 44, leaf spring 54 housed in groove 50 serves to urge the seal strip into contact with rotor 15, but not at the mid-point of its length, where it might otherwise cause seal strip 44 (or 45) to bend when the ports of rotor 15 cross the seal strips. The curved shape of groove 50 having a centre 56, (see FIG. 2) allows strip seal 44 to have sufficient depth, at the mid-point along its length, to resist bonding forces, while still being shallow at each end.

Thus as will be seen in FIGS. 2 and 11, a straight groove of sufficient depth to accommodate strip seal 44 as indicated by dotted line 60, if produced for example by broaching would interrupt the journal surfaces of bearings 17 and 18 and also unduly weaken the cylinder-head. This area is inevitably weak, as the rotor must be located low in the cylinder-head in order to raise the compression ratio. Furthermore, the integrity of sealing of the array of seals around window 43 would be seriously reduced if the space at the bottom of groove 50 was not sealed at its ends by reason of the substantial overlap 61 which, as can be seen from FIG. 11, amounts almost to one half of the radial thickness of ring 46, and close fit of ring 46 in groove 48 and to the end of strip seal 44. Such effective sealing is provided as illustrated in FIG. 11, whereas it can be seen that if a straight slot 60 were used, and the space at the bottom of groove 50 communicated directly to the space at the bottom of the circumferential grooves 48 and 49, (and particulary if it continued to the ends of bore 19), gas leakage out and oil leakage into the sealing zone would occur.

A further mode of leakage referred to earlier, though less critical, is a leakage between adjacent ports of the rotor across the common land (57*a*). It is in respect to this leakage path that the novel bearing arrangement according to this invention is important. A clearance not exceeding say five thousandths of an inch may be provided, even allowing for the effects of bowing and wear, and deflection of rotor 15 due to gas pressure and heat distortion and this will suffice to prevent excess leakage between adjacent ports at the low pressure differential which occurs therebetween. This would not be achievable with conventional bearing arrangements.

In order to maintain the segments of the seal rings 46 and spring 53 in their correct position, pins 59 and 59*a* are provided in the root of the circumferential grooves segment 46*x* has a slot which engages this pin, and similarly spring 53 has a hole 61. Thus, provided that segment 46*x* is correctly positioned, segments 46*y* and 46*z* will be carried around to abut each other in surface contact by the friction of contact with rotor 15.

The above embodiment of the invention which incorporates both aspects thereof in one construction is given by way of example only and variations within the general scope of either aspect of the invention will be readily devised by those skilled in the art.

I claim:

1. A rotary valve for an internal combustion engine comprising a hollow cylindrical rotor having at some point along its bore an inclined baffle, two rectangular ports in the periphery of the valve angularly disposed one to the other positioned along the axis adjacent the baffle, one port communicating with the bore on one side of the baffle and vice versa, a cylinder head having a bore in which said rotor rotates in a predetermined small clearance fit, a window in said cylinder head bore communicating with a combustion chamber, rolling element bearings one adjacent each side of said ports for journalling said rotor in said cylinder head, said rolling element bearings serving to maintain the said predetermined small clearance fit, longitudinal sealing elements housed directly within said bore of said cylinder head extending inwardly from said bore an amount equal to said predetermined clearance, said sealing elements having at each end a radially extending surface square to the axis of said bore and being housed within blind-ended longitudinal grooves formed integrally within said cylinder head, said grooves being of varying depth along their length, deep at the mid point thereof and shallower towards the ends of said bore, said grooves being positioned one on each side circumferentially of said window, at least two circumferential rings positioned along the axis of said rotor immediately adjacent respective radially extending end surfaces of said sealing strips, said circumferential rings having a small radially extending overlap with said sealing elements, said longitudinal sealing elements and said circumferential rings constituting an array of sealing elements providing a sealing window having four sides which floats with the motion of the periphery of said valve.

2. A rotary valve as claimed in claim 1 in which said longitudinal grooves are deep at the mid point along their length and shallow at the ends thereof.

3. A rotary valve as claimed in claim 1 or claim 4 in which said annular grooves are formed directly within the cylinder-head bore and each said circumferential ring comprises at least three separate segments, two of which are lapped one to the other to preclude ingress of oil axially of the rotor along said lap.

4. A rotary valve as claimed in claim 1 wherein the radial depth of the longitudinal grooves at the ends thereof are less than the radial width of the face of each circumferential ring against which the longitudinal strip in the groove abuts so impeding the ingress of oil along the root of the groove from the root of the circumferential groove housing said circumferential ring.

* * * * *